United States Patent [19]

Korshunov et al.

[11] 4,073,333

[45] Feb. 14, 1978

[54] METHOD OF CONTINUOUS CASTING OF INGOTS

[76] Inventors: Evgeny Alexeevich Korshunov, pereulok Otdelny, 5a, kv. 29; Nikolai Ivanovich Bainov, ulitsa Kominterna, 20/17, kv. 1; Igor Nikolaevich Petrov, ulitsa Malysheva, 152b, kv. 30; Georgy Fedorovich Konovalov, ulitsa Bazhova, 130/79, kv. 17, all of Sverdlovsk; Mikhail Iosipovich Arshansky, prospekt Lenina, 23/40, kv. 8, Nizhny Tagil; Petr Genrikhovich Shmidt, ulitsa Gagarina, 35, kv. 186, Sverdlovsk; Valery Pavlovich Kostrov, ulitsa Bazhova, 57, kv. 10, Sverdlovsk; Petr Evgenievich Efremov, ulitsa Tolyatti, 28, kv. 6, Novokuznetsk Kemerovskoi oblasti, all of U.S.S.R.

[21] Appl. No.: 699,173

[22] Filed: June 23, 1976

Related U.S. Application Data

[63] Continuation of Ser. No. 535,153, Dec. 23, 1974, abandoned, which is a continuation of Ser. No. 422,151, Dec. 6, 1973, abandoned.

[51] Int. Cl.[2] ..... B22D 11/04; B22D 11/08

[52] U.S. Cl. ..... 164/66; 164/76; 164/82; 164/86

[58] Field of Search ..... 164/66, 76, 82–86, 164/270, 281, 273 R, 274; 29/527.5, 527.7

[56] References Cited

U.S. PATENT DOCUMENTS

| | | | |
|---|---|---|---|
| 3,302,252 | 2/1967 | Woodburn, Jr. | 164/281 |
| 3,445,922 | 5/1969 | Leghorn | 164/83 X |
| 3,653,427 | 4/1972 | Evans | 164/82 X |
| 3,669,176 | 6/1972 | Krall et al. | 164/83 X |
| 3,680,624 | 8/1972 | Watts | 164/85 |

FOREIGN PATENT DOCUMENTS

| | | | |
|---|---|---|---|
| 39,345 | 1970 | Japan | 164/85 |
| 39,346 | 1970 | Japan | 164/85 |
| 265,385 | 1970 | U.S.S.R. | 164/82 |

*Primary Examiner*—Francis S. Husar
*Assistant Examiner*—Gus T. Hampilos

[57] ABSTRACT

A method of continuous casting of an ingot by way of its recurrent upward drawing from a radial cooled mould into which molten metal is forced from a bottom of a supply vessel. Pressure is increased inside the ingot being formed in the period of a pause between its drawing from the mould for a tighter fitting of the ingot skin to the walls of the mould, and, once the ingot skin of a prescribed thickness is solidified, the pressure is reduced in the molten metal enclosed by the skin. Thereafter a hole is made in the upper butt portion of the ingot skin and a neutral gas is fed through the hole until the levels of the molten metal in the mould and in the supply vessel are equalized; then the ingot is drawn from the mould. The newly formed upcast branch of the ingot envelope is reduced with the aid of rolls in the course of drawing to a continuous section of a prescribed shape, the volume of a neutral gas (gas cushion) enclosed by the envelope being ahead of the reducing rolls. The method is good for the production of flat, profiled and multilayer ingots.

5 Claims, 11 Drawing Figures

METHOD OF CONTINUOUS CASTING OF INGOTS

This is a continuation of application Ser. No. 535,153 filed Dec. 23, 1974 now abandoned while in turn is continuation of Ser. No. 422,151 filed Dec. 6, 1973, now abandoned.

BACKGROUND OF THE INVENTION

The invention relates to a method of continuous casting of ingots, which is realized in radial continuous casting plants.

In the past ten years, radial and especially curvilinear plants of continuous casting have been extensively gaining acceptance since they are fit for casting large-size ingots with a cross-sectional area amounting to 300×2000 mm. The speed of the ingot drawing (extraction) from the cooled mould reaches 2 m/min.

Large-size ingots cannot be practically cast at such speeds in the known vertical plants used so far.

In radial plants, the ingot is straightened right after it has passed the downcast portion.

However, in the course of ingot straightening, if the ingot has not yet solidified, marked strectching deformations emerge on the solidification boundary, that may cause inner defects in the ingot. To deal with them, a cooled mould with a large curvature radius was provided, that lead, however, to an increased height of the plant.

In the curvilinear plant, the ingot is being straightened gradually within a secondary cooling zone section of a considerable length; therefore, stretching deformations on the metal solidification boundary are negligible and do not cause dangerous deformations. An increase in the height of the casting plant can be thus avoided.

Known in the art is a method of producing massive metal ingots in a radial continuous casting plant intended for producing hollow pieces, according to which, first to be formed is a downcast portion of the ingot, with an upcast portion being formed second (Austrian Pat. No. 286519). Both the downcast and upcast portions of the ingot form a solidified envelope enclosing molten metal, a hollow portion being formed in the upcast branch above the level of the molten metal. The upper hollow portion of the ingot is exposed to a sizeable reduction right in the plant, which ensures both the sealing of the hollow of the ingot envelope and further deformation (shaping) of an ingot portion with a continuous cross section.

The reduction of the ingot hollow envelope by this method takes place above the level of the molten metal therein in the upcast branch. Formed between the metal meniscus in the upcast branch and the reduced portion of the ingot is a closed volume termed a "gas cushion".

According to the technique described in the Austrian Patent, the "gas cushion" in the ingot envelope is created after the ingot has passed the downcast portion prior to passing the upcast one. The "gas cushion" produces no effect upon the initial formation of the skin (envelope) of the ingot; neither does it influence the formation of the structure of the solidifying skin or assist the formation of the multilayer ingot.

Also, quite probable variations in the physical parameters of the "gas cushion" such as temperature, volume, and pressure may cause fluctuations in the level of the meniscus of the molten metal in the mould, which is undesirable in the course of the ingot's downward travel out of the mould.

Even short pauses in the travel of the ingot being cast may result in the solidification of the metal meniscus within the gas cushion zone, which may cause the compression of the gas cushion with the subsequent destruction of the solidified meniscus and the discharge of the molten metal in the zone of the mould being cooled.

Also, the completion of the ingot casting is impeded as it is not possible to continue the reduction of the hollow ingot after its end has escaped from the mould being cooled because otherwise this would result in the discharge of the liquid phase of the ingot into the secondary cooling zone. To prevent this, it is necessary to ensure complete crystallization of the downcast and upcast portions of the ingot being cast, but this would require more powerful facilities for reducing such ingot to a present section.

Known also in the art is a method of continuous casting of ingots from liquid metal fed from a vessel through a bottom gate to a curvilinear mould cooled radially, with a dummy bar being introduced into the space of the mould prior to casting. In forming an upcast radial branch of the ingot, the latter is regularly withdrawn upward from the mould into a secondary cooling zone. During the ingot formation, the pressure of the molten metal in the envelope of the ingot being cast is raised by cycles in the mould zone at the beginning of the pause between ingot drawings and then reduced at the end of the pause (USSR Inventor's Certificate No. 265,385. The rise in the molten metal pressure on the ingot skin ensures its fitting along the walls throughout the mould height.

Prior to drawing the solidified skin of the ingot from the mould, the pressure in the bottom gate should be reduced, and the molten metal in the ingot being cast is balanced with the aid of an electromagnetic field induced by inductors arranged in the upcast branch of the zone of the secondary cooling device.

As a result, the solidifying skin of the ingot in the mould zone is released from the metallostatic pressure and its further drawing from the mould is facilitated, as this drawing can be performed without causing the destruction of the ingot skin.

The continuous casting of the ingot with its periodic upward drawing from the radial cooled mould, as described in the above Inventor's Certificate, offers considerable advantages over the known method of continuous casting through the radial mould with the downward ingot drawing, as it helps increase the average speed of the ingot travel and, consequently, the efficiency of the plant, as well as improve the surface finishing of the ingot being cast.

However, in realizing this method for casting a number of metals, e.g., steel, a mould with a length of more than 1.2–1.4 m cannot be used, as it does not help reduce the load on the ingot skin to a required value prior to drawing the ingot from the mould. Meanwhile, in the course of the periodic drawing of the ingot from the mould, the average speed of the ingot travel and, consequently, the efficiency of the plant is nearly directly proportional to the length of the mould, and the greater its length, the higher the average speed of the ingot travel and the efficiency of the plant.

Furthermore, a limited length of the mould leads to a greater number of joints in the ingot cast continuously, which is undesirable.

In producing large-size ingots, the liquid phase in the ingot being cast spreads throughout the upcast portion. For its imperative balancing prior to the ingot drawing from the mould, a relatively strong magnetic field is required, which, necessitates, consequently, the provision of powerful inductors that cannot but complicate the construction of the plant.

This method does not permit the casting of multilayer ingots, whereas the production of profiled ingots through such techniques is impeded.

Note should be made that despite a variety of methods and plants developed in the sphere of continuous casting of metals, a number of problems still await their solution.

With the efficiency of modern metallurgical works being on the rise, present-day plants yet fail to provide adequate casting of all of a metal into ingots of a required section within a prescribed time. Therefore, they have to resort sometimes to an unwarranted increase in the size of ingots being cast and, naturally, the subsequent rolling of the latter necessitates the provision of the related plants of a greater capacity. To cope with the problem, it is necessary to provide for the techniques which permit casting at a far greater average speed of travel of the ingot being cast.

Another important problem of continuous casting, not solved completely, is to raise the quality of the ingot being cast (better surface finishing and improved inner structure).

Present-day requirements call for more bimetallic or multilayer ingots whose production process still remains complicated and expensive; in fact, there are no effective methods that help cast massive multilayer ingots continously.

Known is a method of producing bimetallic or multilayer ingots of limited lenths, involving centrifugal casting with a gradual introduction of varying chemical compounds into the metal form.

Another method involves the production of multilayer ingots through rolling packets of sheets made up of heterogeneous metals and prepared in advance.

In the method described in the U.S. Pat. No. 3,625,277, when casting metal for the production of multilayer ingots, the mould is moved toward the ingot being cast, i.e., horizontally. As this takes place, metal of a different chemical composition, intended for forming the ingot layers, is fed in turn to the space of the solidified skin of the ingot.

Bimetallic ingots cast continuously are produced by applying the second layer of the molten metal on the base prepared of the first metal in advance.

However, the first three methods of producing multilayer ingots involve the recurrent casting of metal and permit casting of ingots of limited lengths.

Also, prior to producing a multilayer ingot by the above-specified methods, it is necessary to do laborious preparatory operations such as, for instance, surface planning, degreasing, removing oxidized surface films chemically, and preventing the metals to be joined from repeated oxidation.

In producing the multilayer ingot of a limited length, too, in the method described in the U.S. Pat., it is practically impossible to produce an ingot with a clear-out boundary between the metal of one chemical composition and the layer of a metal of another chemical composition, because the second metal is introduced into the ingot space when there is a liquid phase of the first metal therein.

Moreover, each of the obtained layers may be of a different thickness throughout the ingot length.

The known methods of continuous casting of multilayer ingots rail to ensure the production of quality ingots as they do not create necessary conditions for the diffusion of one metal into another.

SUMMARY OF THE INVENTION

The primary object of a invention is to provide the method of continuous casting of ingots which permits an increase in the speed of forming the ingots.

Another, not less important object of the invention is to improve the surface finish and structure of the ingot.

Yet another object of the invention is to produce profiled and multilayer ingots.

These and other objects of the invention are accomplished by providing a method of continuous casting of ingots from molten metal forcibly fed from a bottom vessel into a radially curved cooled mould, a dummy bar being introduced into the space of the mould, prior to casting, for recurrent drawings of the ingot into a secondary cooling zone. As the ingot is being formed as an upcast radial branch, a molten metal pressure rise is provided to bear on the forming skin of the ingot at the beginning of the pause between the ingot drawings and a pressure drop provided at the end of the pause, the ingot being returned, after each drawing, to a value of the contraction of an ingot portion being formed in the mould, wherein, according to the invention, a dummy bar is introduced, which has a through channel in its middle section throughout its height, so that a hole should be made through the channel in the ingot skin during one of the initial periods of the ingot extraction after decreasing the pressure therein for a neutral gas to be supplied to the ingot space in order to equalize the levels of the molten metal in the radial curved cooled mould and the vessel communicating with the latter. Thereafter, once the "gas cushion" is formed in the ingot envelope, molten metal is fed to the latter in the course of the ingot drawing and at the beginning of the pause until a pressure is created that would secure the fitting of the ingot skin to the walls of the radial curved cooled mould, the ingot skin being held until a preset thickness is obtained and the molten metal being returned to the radial curved cooled mould until its level equals that of the metal in the vessel, after which the operations specified to take place following the formation of the "gas cushion" until the formation of the upcast branch of the ingot are repeated. The upper portion of the ingot beyond the "gas cushion", in the form of an envelope, is straightened and reduced to a continuous section at a distance corresponding to the size of the formed lower portion of the ingot, drawn out of the mould, in the course of each drawing of the ingot from the mould.

Such technique ensures the stepped-up formation of the ingot owing to a higher average speed of the ingot travel, which, in case of recurrent drawings of the ingot from the mould, largely depends on the length of the latter. Owing to the "gas cushion" provided for the ingot being cast, the length of the mould may be fairly long amounting to 2,3 or even 4 meters.

The provision of the "gas cushion" helps to form ingots in the course of the continuous flow of the molten metal relative to the entire solidifying front. This ensures a fine-grained structure in the ingot.

Also, the upward feed of the ingot from the mould, combined with the provision of the "gas cushion" in the cast ingot, permits changing metal of the core portion of the ingot of one chemical composition by metal of another chemical composition and thus to ensure the most economical production of continuously cast bimetallic or multilayer ingots.

It is advantageous if the molten metal is returned and fed, in the newly formed upcast branch of the ingot between the ingot drawing and after feeding the molten metal into the branch to a pressure ensuring the fitting of the ingot envelope to the mould walls, at a speed of 0.5–1.5 m/sec so that its level should be gradually decreasing by 0.5–2 m and then restoring.

Such variations in the level of the molten metal in the ingot ensure dynamic impact of the metal on the liquid-solid inner layer of the solidifying skin of the ingot, thus causing the disintegration of the growing crystals of the layer as a result of which the ingot skin structure becomes fine-grained and of a higher quality.

It is practical to feed a cooling agent with a temperature of 100–400° C to the radial cooled mould some 1–3 sec prior to the start of ingot drawing from the mould in the course of drawing and during 0.4–0.6 of the time of the pause between ingot drawings.

The feed of the cooling agent of an elevated temperature to the mould within the above-specified time ensures the leading expansion of the mould walls prior to the drawing of the ingot from the mould, compared with the expansion of the ingot skin, which is conducive to decreasing the effort of the ingot drawing from the mould, decreasing the supercooling of the ingot skin and, consequently, decreasing heat stresses therein.

The subsequent change of the above cooler for a cooling agent with a commonly adapted temperature ensures the leading contraction of the mould walls, compared with the ingot, extra pressure of the mould walls against the ingot and stepped-up heat removal through the mould walls, which is favorable for the formation of the ingot skin.

It is possible to separate the envelope of the upcast branch of the ingot from the molten metal that formed it and then feed a metal of another chemical composition into it, keeping the envelope under pressure until the formation of an inner layer therefrom; thereafter, the operations should be repeated until a prescribed number of ingot layers is obtained.

Thus, it is possible to obtain bimetallic and multilayer ingots.

It is practical that, prior to feeding the molten metal of a chemical composition other than that of the ingot envelope, the envelope should be heated by 100–200° C and, once the metal of the other chemical composition is fed, be cooled quickly.

The filling of the heated envelope with the molten metal of the other chemical composition and its subsequent stepped-up cooling is conductive to some reduction of the inner envelope being formed of the metal of the other chemical composition. Such reduction, when combined with the inner pressure being created, ensures the fitting of one layer to another as well as favorable conditions for the diffusion of one metal into another, which enhances their cohesion.

BRIEF DESCRIPTION OF THE DRAWINGS

The invention will be more apparent from the description of an exemplary embodiment, reference being made to the appended drawings, wherein.

P is the pressure in the molten metal; and

Figure 9:
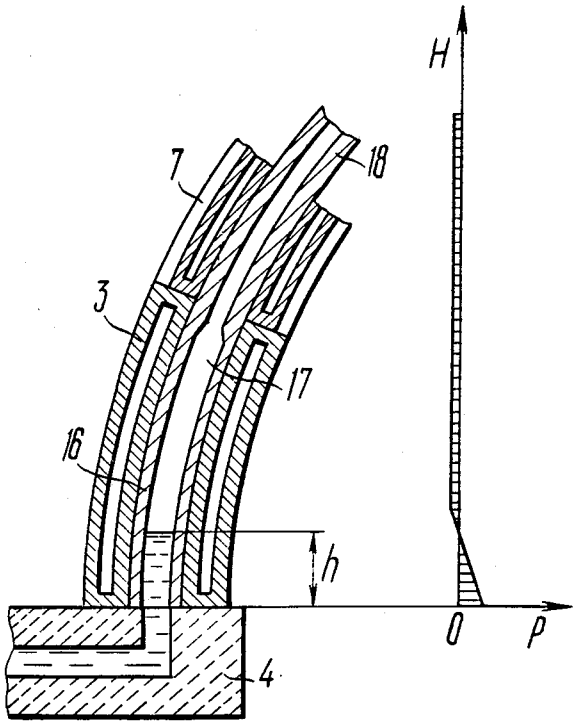
Figure 11:
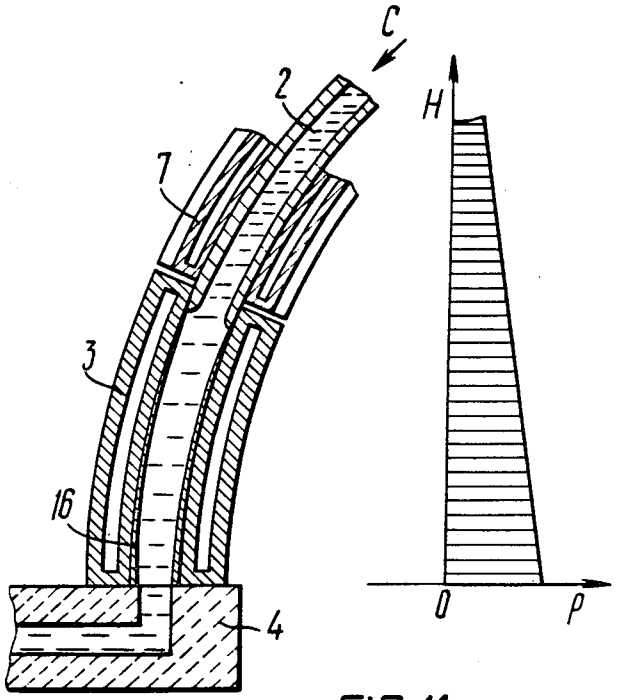
Figure 10:
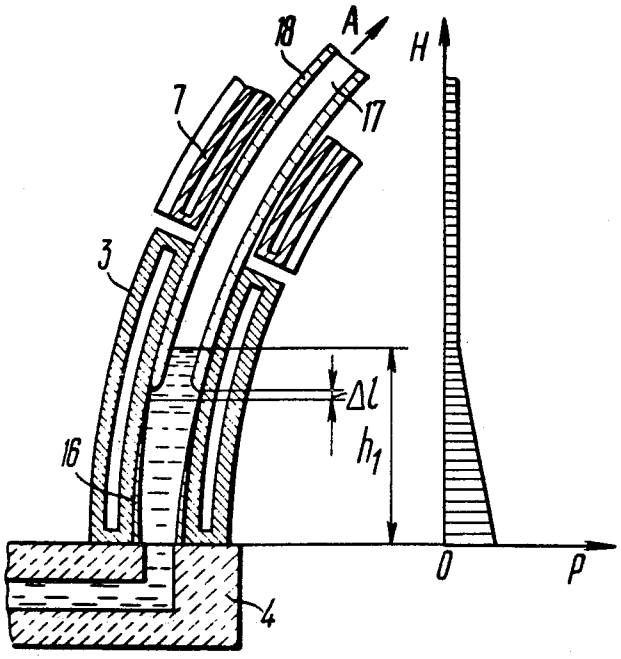

O is the origin of coordinates;

FIG. 9 shows the second phase of the operational cycle and a diagram of the pressure in the molten metal and the gas cushion inside the ingot being cast;

FIG. 10 shows the third phase of the operational cycle and a diagram of the pressure in the molten metal and the gas cushion inside the ingot being cast; and FIG. 11 shows the fourth phase of the operational cycle and a diagram of the pressure in the molten metal inside the ingot being cast.

DETAILED DESCRIPTION OF THE PREFERRED EMBODIMENTS

For the realization of the method, it is possible to use a plant comprising an intermediate vessel 1 (FIG. 1) for the reception of molten metal 2 and a stationary radial cooled mould 3, with a bottom gate 4 for the forced feeding of the metal 2 from the intermediate vessel 1 into the cooled mould 3 being provided between the veseel 1 and the mould 3.

The mould 3 is connected to the bottom gate 4 via a lower butt end.

Above the mould 3 in the direction of the operational process along the radially curved upcast branch of an ingot 5 being cast is a secondary cooling device 6 made up of commonly known elements such as water-cooled guide bars 7 and roll sections 8.

In case of necessity, there may be inductors with water-cooled shoes (not shown in the drawings) provided in place of the water-cooled guide bars 7 and the roll sections 8.

Figure 3:
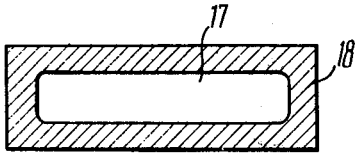
FIG. 3 shows a section taken along line III—III of FIG. 1 of an ingot with a rectangular cross section, whose inner space is filled with a neutral gas.
Figure 4:
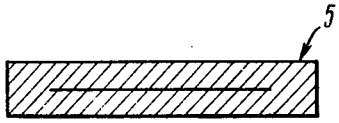
FIG. 4 shows a section taken along line IV—IV of FIG. 1 of an ingot envelope after its reduction to a continuous cross section.
Figure 5:
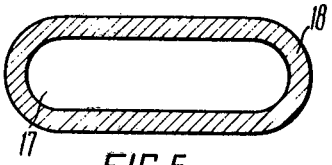
FIG. 5 shows a cross section of the envelope of an ingot with an oval cross section whose space is filled with a neutral gas, prior to the reduction of the envelope in order to make it profiled.
Figure 6:
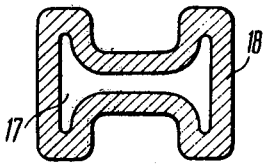
FIG. 6 shows a cross section of the ingot envelope after the initial phase of deformation.
Figure 7:
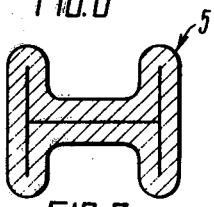
FIG. 7 shows a cross section after the reduction of the ingot envelope until the formation of the continuous profiled section.

Following the branch of the secondary cooling device 6 is a stand 9 for reducing the upper portion of the ingot 5 (FIGS. 3 and 5) in order to obtain a continuous section of a required shape (FIGS. 4, 6 and 7).

Figure 2:
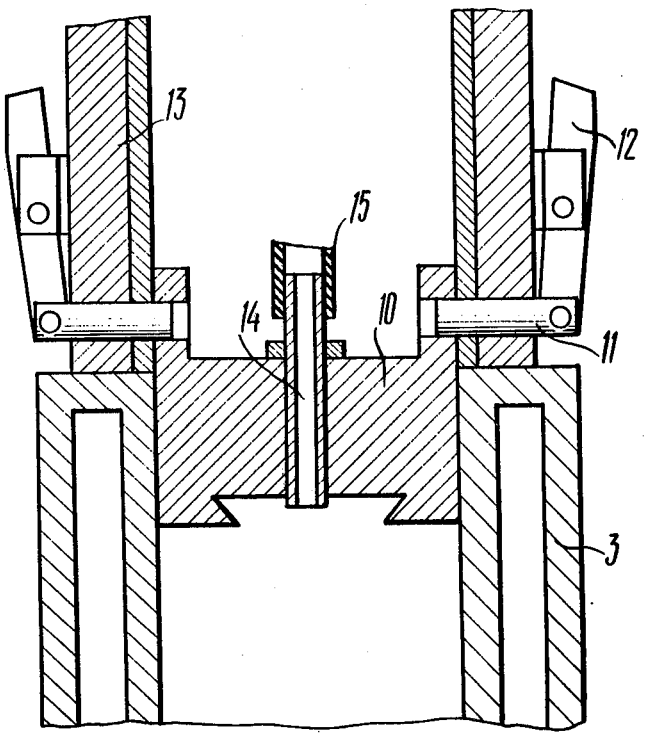
FIG. 2 shows an upper portion of the mould with a dummy bar introduced therein and connected to a drawing device, longitudinal section.

For the initial drawing of the ingot 5 from the mould 3, there is a dummy bar 10 (FIG. 2) connected, by means of bars 11 of a grip 12, with a drawing device 13 provided in the zone of the upcast branch of the secondary cooling device 6. In its middle portion, the dummy bar 10 has a through channel 14 intended for forcing the air out of the mould 3 when the latter is being filled with the molten metal 2; besides, it has an adapter 15 for connection to a neutral gas source (not shown in the drawings). The diameter of the channel 14 is sufficient to accommodate any (not shown) of the known devices, that fits for making a hole in the skin of the ingot 5, formed at the lower butt end of the dummy bar 10.

The method is realized in the following way.

Prior to the start of the continuous casting of the ingot 5, the dummy bar 10 is introduced into the upper portion of the mould 3 (FIG. 2) and connected, via the rods 11, with the drawing device 13.

The lining of the intermediate vessel 1 (FIG. 1) and the channel of the bottom gate 4 should be heated, if necessary. The operational process of casting the ingot 5 starts with feeding the molten metal 2 into the space of the mould 3 via the bottom gate 4; this operation can be performed either with the aid of an induction pump arranged in the bottom gate 4 or directly from the intermediate vessel 1 intended to receive the molten metal 2.

The filling of the space of the mould 3 with the molten metal 2 continues until the molten metal contacts the lower butt end of the dummy bar 10 (FIG. 2); the process is accompanied with forcing the air from this space through the channel 14 provided in the dummy bar 10.

Once the mould 3 is filled with the molten metal 2 by means of the induction pump in the bottom gate 4 (FIG. 1) or through pressure created in the intermediate vessel 1, a pressure of some 3 to 6 atm is created in the liquid phase of the ingot 5 being cast in the zone of the mould 3. Under such conditions, a forming skin 16 of the ingot 5 fits the walls of the mould 3 and grows (thickens) at a high rate.

After a period of time of some 15 to 60 sec (depending on how thick the ingot skin 16 in the zone of the mould 3 must be) elapses, and prior to the initial drawing of the ingot 5 from the mould 3, the pressure in the lower phase of the ingot in the zone of the mould 3 is decreased and, once the lower butt end of the dummy bar 10 introduced into the mould 3 (FIG. 2) is higher than the level of the molten metal 2 in the intermediate vessel 1 (FIG. 1), a hole is made in the upper butt portion of the formed skin of the ingot, through which a neutral gas is fed into the space, and some of the molten metal 2 is returned from the ingot 5 to the intermediate vessel 1; thereafter the supply of the neutral gas is discontinued.

Furtheron, the formed ingot skin is drawn upward at a high speed to a distance close to, but not exceeding, the top of the mould; simultaneously, the molten metal 2 is fed from the intermediate vessel into the space of the ingot 5 being cast via the bottom gate 4.

The speed of ingot drawing and the speed of ascending of the molten metal fed into the ingot is maintained such as to ensure that the lower butt of the ingot portion being drawn should be followed by the liquid phase of the metal throughout the drawing period.

After the ingot is drawn from the mould 3 to a preset distance, the travel of the ingot discontinues, and the ingot at once is moved back to a distance close to the value of the longitudinal contraction of the fresh ingot portion being formed in the mould. The backward movement of the ingot to this distance is necessary to preclude the emergence of cracks at places where respective portions are to be joined.

The feed of the metal continues via the bottom gate 4 even after the discontinuation of ingot drawing. An earlier formed "gas cushion" 17 (FIG. 1) contracts and does not impede the supply of the molten metal 2 into the ingot space.

The liquid metal 2 is fed into the inner space of the ingot until a pressure of some 3–6 atm is created in the zone of the mould 3. After that, the molten metal 2 is held for the formation of a successive portion of the ingot skin in the mould zone, and all of the steps are repeated in the order described hereinabove; note should be made that, if the amount of gas supplied to the space prior to the initial cycle of ingot drawing was not sufficient, the lacking amount of the neutral gas 17 should be introduced into the ingot space prior to the second drawing cycle, when some of the metal was returned to the intermediate vessel 1.

The ingot 5 being cast, drawn along the entire upcast radial branch of the zone of the secondary cooling device 6 and filled in the upper part with the neutral gas 17 (FIGS. 3 and 5) goes to the stand 9 (FIG. 1) where, during each successive drawing of the skin 16 of the ingot, the upper portion of an envelope 18 is reduced to a continuous rectangular (FIG. 4) or profiled (FIG. 7) section and gets straightened at the same time.

Figure 1:
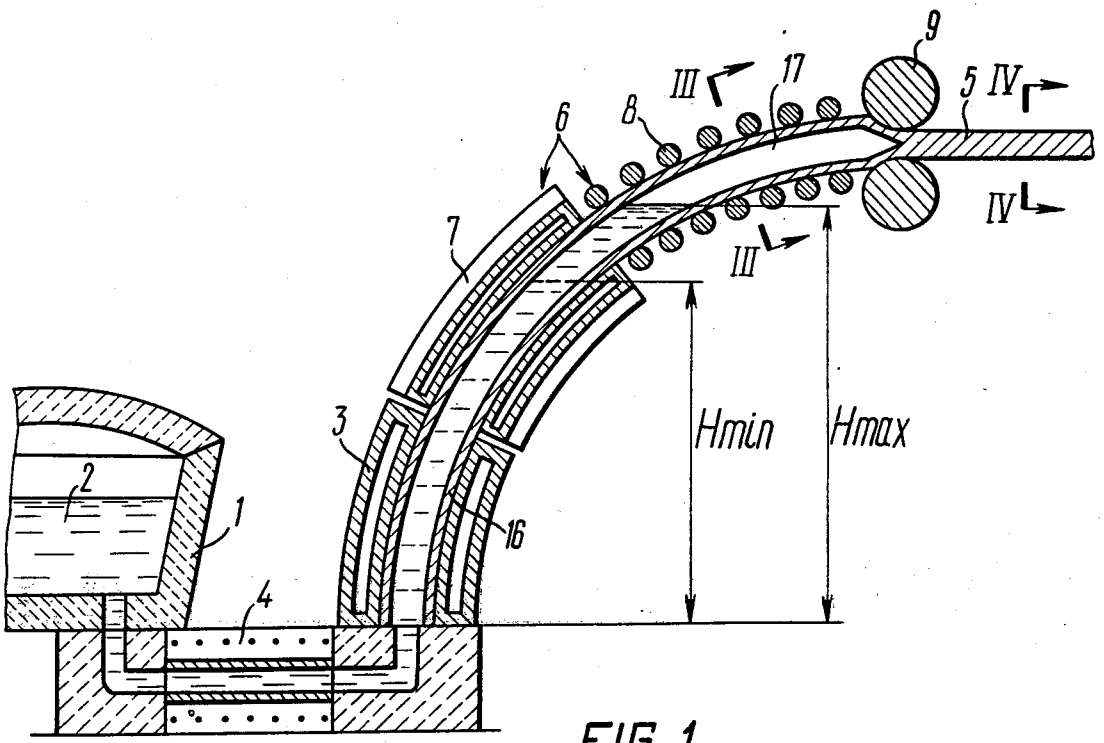
FIG. 1 shows a plant for the realization of the method of the invention, vertical plane section along the longitudinal axis.

The ingot reduction begins after the dummy bar 10 (FIG. 2) has passed between the rolls of the stand 9 (FIG. 1). Then the dummy bar 10 is removed from the head portion of the ingot 5 being cast.

To produce a continuous ingot of a simple shape (square, rectangle) from the formed envelope 18, it is sufficient to provide for one stand 9 (FIG. 1) for reducing the envelope 18 to a continuous section.

It is necessary to obtain a continuous profiled ingot (FIG. 7) from the envelope 18, it is practical to provide for two stands for reduction to be carried out in two stages in succession. First, the ingot envelope 18 is reduced to obtain a rough preset shape (FIG. 6). Second, it is reduced to a continuous section (FIG. 7). In the last case, it is recommended to install inductors at the end of the upcast portion of the secondary cooling zone and with their aid to heat the envelope externally by means of induction currents to impart good deformation properties. (The plant with two stands and inductors is not shown in the drawings).

After the head portion of the ingot being cast has passed the stand 9 (FIG. 1), the routine cyclic process of casting is set with the recurrent upward supply of the ingot from the mould 3 and the utilization of the "gas cushion" 17 inside the upper portion of the ingot cast.

Each cycle has four stages.

Figure 8:
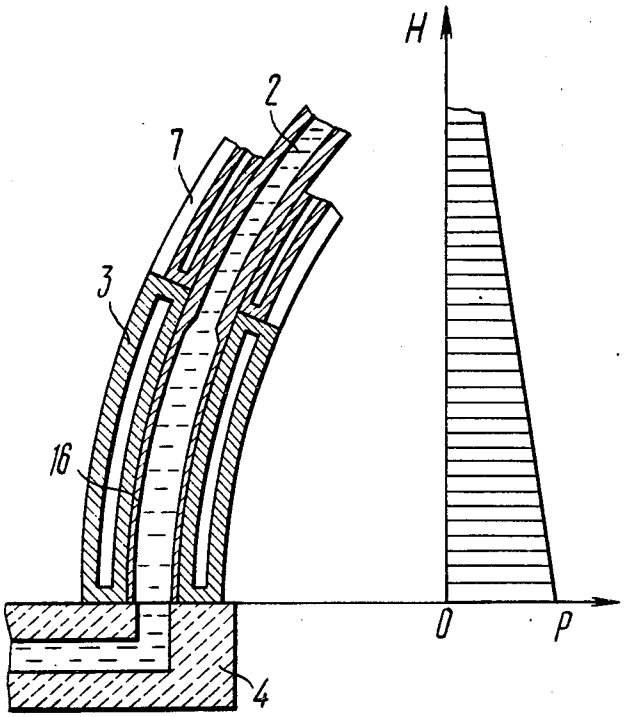
FIG. 8 shows the first phase of the operational cycle and a diagram of the pressure in the molten metal inside the ingot being cast, where H is the height of the upcast branch of the ingot being cast.

The first stage: a portion of the skin 16 (FIG. 8) of the ingot 5 is formed under stationary conditions under a pressure of some 3 to 6 atm. This pressure is determined by the height of the column of the molten metal 2 in the upcast branch of the ingot 5 being cast and the pressure inside the reduced "gas cushion" 17.

Since the skin 16 of the ingot 5 is pressed against the walls of the mould 3, the skin 16 shows quick and uniform growth along the perimeter and the height of the mould 3, its free contraction is precluded, contraction deformations change into plastic ones, and the ingot surface is exempt from outer defects. The strength characteristics of the ingot skin 16 turn out sufficient to stand loads developing in the course successive drawing of the ingot skin from the mould 3.

The second stage: the removal of the load on the skin 16 of the ingot 5 (FIG. 9) by returning the molten metal from the ingot being cast to a level $h$ in the intermediate vessel 1 (FIG. 1) and expanding the "gas cushion" 17 (FIG. 9) with the possibility of the pressure in the "gas cushion" 17 in the inner space of the ingot cast being smaller than the atmospheric one, once the metal returned to the intermediate vessel 1.

The third stage: quick drawing (pointer A on FIG. 10 indicates the direction of drawing) of the ingot skin from the mould 3 with a simultaneous feed, via the bottom gate 4 (FIG. 1), to the zone of the mould 3 of such an amount of the molten metal 2 that its level $h_1$ (FIG. 10) in the ingot being cast be continuously higher than the lower butt end of the formed ingot portion being drawn.

In the course of drawing the ingot from the mould 3, a layer of the molten metal 2 is preserved beyond the lower butt end of the ingot portion being crawn throughout $\Delta 1$ of the newly formed ingot skin. As soon as the ingot stops, this layer disappears forthwith, while during the slow movement of the ingot, its value approaches zero, which is not favorable, as defects may emerge on the ingot surface.

During the third stage, a new portion of the skin 16 of the ingot 5 (FIG. 10) begins to form, the length of this portion growing from zero to a value by which the earlier formed envelope 18 of the ingot was drawn from the mould 3.

Final treatment of the ingot envelope formed on the upcast branch during this period throughout the length equal to the length of the portion being drawn involves the reduction to a continuous simple (FIG. 4) or profiled cross section (FIG. 7).

The fourth stage: the drawing of the ingot from the mould 3 (FIG. 11) discontinues and the ingot is moved reversely (indicated by pointer C) to a distance sufficient for the compensation of the longitudinal contraction of the new portion of the ingot. This ensures such junction of the portions of the ingot cast to be joined, which prevents the emergence of defects in the place of joint.

After the stop of the ingot travel and its reverse motion, the feed of the molten metal into the inner space of the ingot continues and, as a result, the "gas cushion" is compressed in the upcast branch of the ingot being cast, This results in a quick rise in the pressure applied to the newly formed skin 16 of the ingot in the zone of the mould 3 to a preset value, and the skin becomes tightly pressed against the walls of the mould 3.

As a result of the established operational process described hereinabove, an ingot of a continuous section is obtained, whose quality is higher than that of an ordinary continuously cast ingot, since the fresh ingot is obtained from the skin portion of the metal. This is one of the important advantages of the production of ingots with the use of a "gas cushion" inside the ingot being cast.

The presence of the "gas cushion" in the ingot being cast permits the producing of dynamic action on the liquid-solid phase of this ingot throughout the solidifying length. For many metals, such dynamic action is, favorable in the course of casting continuous-section ingots since it permits the obtaining of a quality ingot with a fine-grained structure during casting.

To produce a dynamic action on the solid-liquid layer of the ingot being cast, it is sufficient to do the following. Once the maximum rise in the molten level $H_{max}$ (FIG. 1) is achieved in the upcast branch of the ingot being cast during the pause between the drawings of the ingot from the mould, the pressure in the bottom gate 4 is decreased and increased repeatedly, depending on the duration of the pause between the ingot drawings, so that the molten metal level in the ingot being cast should vary (decrease or increase) approximately by a distance of 0.5–2 m and from $H_{max}$ to $H_{min}$ and the metal should move in the ingot being cast at a speed of some 0.5–1.5 m/sec.

The provision for dynamic action on the solidifying layer permits, in addition to an effect leading to the formation of the fine-grained structure throughout the entire section of the ingot skin being formed, to extend the pause between the drawings of the ingot from the mould and preclude the freezing-in of the metal in the channel of the bottom gate or the freezing-in of the metal meniscus in the ingot being cast.

The provision of the "gas cushion" in the inner space of the ingot being cast permits the obtaining of not only continuous ingots of a preset shape, made of a metal of one chemical composition, but also continuous ingots made of metals with different chemical compositions, i.e., bimetallic or multilayer ingots.

The process of the production of a multilayer ingot consists in that the primary envelope is formed initially, the operational process of producing the primary envelope in no way differing from that of casting an ingot from a metal of an equal chemical composition (the description of this operation cycle is furnished hereinabove), Furtheron, the recurrent drawing of the ingot from the mould is discontinued, and the remainder of the primary metal is drained into a bucket from the envelope being cast and from the intermediate vessel. Fed into the intermediate vessel 1 is a metal of another chemical composition, which is then supplied to the envelope 18 of the ingot, via the bottom gate 4, up to a preset level.

The metal of a chemical composition other than that of the skin 16 of the ingot, is seasoned, under the pressure of the "gas cushion", as long as required to obtain a preset thickness of the secondary layer (skin and envelope) of the ingot, as this takes place, it is recommendable, like in the case of forming the primary envelope, to raise and lower the molten metal in the ingot space by some 0.5–2 m, when forming the secondary layer of the metal.

After the layer of the metal of the chemical composition other than that of the ingot envelope has been formed, the remainder of the molten metal is disposed of into the intermediate tank 1 and, if necessary, a successive metal is introduced similarly therein for the formation of a third layer.

In case it is not necessary to introduce the metal of the third chemical composition, the primary metal should be fed into the intermediate vessel after the removal of the liquid remnants of the secondary metal, recurrent drawing of the ingot out of the mould is resumed, the formation of the primary envelope of the ingot is continued and the already formed multilayer envelope is reduced to obtain a continuous section of a preset shape.

The provision of a pause during the recurrent upward drawings of the ingot from the mould, in the course of which the ingot skin is being formed in portions in the mould under stationary conditions, permits the regulating of the thermal regime of the initial formation of the ingot skin.

In the periods of the recurrent cycles of the ingot casting operation, a cooling agent is fed, preferably a liquid-metal one and of a differing temperature, to the mould 3.

1 to 3 seconds prior to the start of the ingot drawing, a cooling agent with a temperature of some 100–400° C is fed to the mould 3; the agent is also used for the continued cooling of the mould during the drawing and within 0.4–0.6 of the time of the pause. This helps ensure the leading expansion of the walls of the mould prior to drawing the ingot therefrom, compared with the expansion of the ingot skin, which is conductive to decreasing the effort of drawing the ingot from the mould, decreasing the supercooling of the ingot skin and, consequently, to decreasing thermal stresses therein.

During the rest of the operational cycle, it is recommended to cool the mould with the cooling agent whose temperature is commonly adapted. Changing the cooling agent with a high temperature by a coolant with a lower temperature should be carried out when the ingot skin of the prescribed thickness has been formed in the mould zone; this will be accompanied by the leading contraction of the mould walls, compared with that of the ingot, extra pressure of the mould walls against the ingot skin, and stepped-up heat removal through the mould walls, which is favorable for the formation of the initial skin of the ingot.

The recurrent upward drawings of the ingot from the mould and the provision of the "gas cushion" in the ingot being cast permits the revising of the production of multilayer ingots.

Once the primary envelope 18 of the ingot is formed and the primary molten metal is removed therefrom, prior to feeding a metal of another chemical composition to the envelope, the ingot envelope should be heated to a temperature of 100°–200° C throughout the length of its filling with the secondary metal.

This is achieved by feeding a coolant with a temperature of 200°–400° C to the mould and by heating the ingot skin in the zone of the secondary cooling, e.g., with an induction current induced in the ingot with the aid of inductors arranged in the secondary cooling zone for the purpose.

Fed into the ingot envelope thus prepared is the secondary molten metal, and after some holding period of about half the time required for the formation of the metal secondary layer, the coolant with a high temperature is substituted with a coolant possessing a lower temperature, whereas stepped-up in the secondary cooling zone is the cooling of the ingot skin.

As a result, it is possible to achieve the leading contraction of the primary skin of the ingot compared with that of the one being formed anew, which is conducive to a tighter fitting of these layers and better diffusion of the metal of one layer into the metal of another layer and, consequently, to a required cohesion of the layers.

We claim:

1. A method of continuous casting of an ingot in a plant provided with a vessel for molten metal, a device for the forced feeding of a molten metal, a radially curved cooled mould, a dummy bar having a through channel in its middle portion along its height, and a secondary cooling device with a radial upcast branch, comprising the steps of: (a) introducing the dummy bar into the radially curved cooled mould; (b) forced feeding a molten metal from the vessel into the mould from a bottom until the molten metal contacts the dummy bar and simultaneously forces out air through the channel in the dummy bar; (c) increasing the pressure of the molten metal applied to an ingot skin being formed and holding the ingot skin being formed to a prescribed thickness; (d) reducing the pressure at the end of the holding; (e) drawing an ingot from the mould to a value close to, but not exceeding the length of the mould at a rate of drawing that ensures the presence of a molten metal layer on a lower butt portion of the skin; (f) forming a hole in the skin of the ingot, made through the channel in the dummy bar during one period of drawing the ingot after reducing the pressure therein; (g) supplying a neutral gas to an inner space of the ingot through the channel in the dummy bar and the hole in the ingot skin, in an amount ensuring the equalizing of the level of the molten metal in the mould to a level close to the level of the molten metal in the vessel, as well as forming a gas cushion in an upper portion of the ingot; (h) feeding the molten metal into the inner space of the ingot when the ingot is being drawn from the mould and when a pause starts, in an amount that ensures a pressure causing the fitting of the skin of the ingot along the mould; (i) decreasing the rate of the ingot drawing until the drawing discontinues completely, the supply of the molten metal continuing; (j) returning the ingot to the mould to a distance close to the distance of the longitudinal contraction of a new portion of the ingot being formed; (k) continuing the feed of the molten metal in the direction of the ingot drawing until a preset pressure is created on the newly formed portion of the ingot; (l) repeating the steps (h)-(k) until formation of an upcast branch of the ingot; and (m) straightening and reducing a continuous section of an upper portion of the upcast branch of the ingot, the section being an ingot envelope spaced from the gas cushion to a distance corresponding to the size of a formed lower portion of the ingot, drawn out of the mould.

2. The method as set forth in claim 1, further comprising the steps of returning and feeding the molten metal into the formed envelope of the upcast branch of the ingot at a rate of drawing of 0.5–1.5 m/sec in the period between the drawing of the ingot and after the feeding of the molten metal into it to a pressure ensuring the fitting of the ingot skin to the walls of the mould, so that the level of the molten metal is gradually decreasing by 0.5–2 m and then restoring the level of molten metal to its original level.

3. The method as set forth in claim 1, further comprising the step of feeding a cooling agent with a temperature of 100–400° C. into the mould 1–3 seconds prior to the start of ingot drawing during the drawing period and during 0.4–0.6 of the time of the pause between ingot drawings.

4. The method as set forth in claim 1, further comprising the steps of releasing the enevelope of the upcast branch of the ingot from the molten metal that formed it; feeding a metal of a different chemical composition into the envelope and holding therein under pressure until an inner layer is formed within the envelope of the upcast branch; and repeating the above operations until a required number of ingot layers is obtained.

5. The method as set forth in claim 4, further comprising the steps of heating the ingot envelope to a temperature of 100–200° C. prior to feeding, into the ingot envelope, the molten metal of a chemical composition other than that of the ingot envelope; and subjecting the envelope to a stepped-up cooling once the metal of the other chemical composition is fed.

* * * * *